US005118007A

United States Patent [19]

Lewis et al.

[11] Patent Number: 5,118,007

[45] Date of Patent: Jun. 2, 1992

[54] TABLET DISPENSER

[76] Inventors: Catherine A. Lewis, 5376 N.W. 55th St., Coconut Creek, Fla. 33073; Loren M. Matthews, 1000 N.W. 96 Ave., Plantation, Fla. 33322; Joseph M. Sher, 6161 N.W. 57 Ct., #309, Tamarac, Fla. 33319

[21] Appl. No.: 601,984

[22] Filed: Oct. 23, 1990

[51] Int. Cl.[5] ..... B65G 59/00

[52] U.S. Cl. ..... 221/30; 221/266; 221/281

[58] Field of Search ..... 221/30, 31, 229, 266, 221/281

[56] References Cited

U.S. PATENT DOCUMENTS

| | | | |
|---|---|---|---|
| D. 249,469 | 9/1978 | Russert | D9/224 |
| 2,255,450 | 9/1941 | Mutchler | 221/30 |
| 2,274,238 | 2/1942 | Henderson et al. | 221/30 |
| 3,830,411 | 8/1974 | Krechmar | 221/266 |
| 3,844,445 | 10/1974 | Haas | 221/229 |
| 3,845,882 | 11/1974 | Haas | 221/279 |
| 3,942,683 | 3/1976 | Haas | 221/229 |
| 4,171,753 | 10/1979 | Vreede | 221/197 |
| 4,295,579 | 10/1981 | Haas | 221/229 |
| 4,589,575 | 5/1986 | Rigberg et al. | 221/198 |
| 4,610,394 | 9/1986 | Bryson | 239/57 |
| 4,749,106 | 6/1988 | Von Schuckmann et al. | 812/96 |
| 4,763,815 | 8/1988 | Von Schuckmann et al. | 222/96 |
| 4,844,295 | 7/1989 | Deardorff | 221/263 |
| 4,854,478 | 8/1989 | Gyimothy | 221/190 |

*Primary Examiner*—H. Grant Skaggs

[57] ABSTRACT

A tablet dispenser for housing a roll of tablets that are wrapped in a foil (or other protective material), and for sequentially removing tablets from the roll by cutting the foil. In one preferred embodiment, the roll is loaded at one end of a hollow case. A cap that attaches to the case via pivot means is located at the end of the case opposite its loading end. With the cap in a closed position, the roll is pressed in as far as possible so that the end-most tablet (to be dispensed) snugly fits to the entire interior of the cap. The cap has teeth along an interior wall. In the process of opening the cap, the teeth cut the foil and lift a tablet from the roll. When the cap is in its closed position, the roll is sealed from dust and other adverse environmental conditions.

6 Claims, 5 Drawing Sheets

TABLET DISPENSER

BACKGROUND OF THE INVENTION

This invention relates to tablet dispensers and more particularly to a dispenser that 1) houses a roll of tablets or other objects which are wrapped in a foil (or other protective material such as wax paper), and 2) removes tablets from the roll, one at a time, by severing the foil. All tablets of a particular roll are of identical shape and size. Types of tablets commonly packaged in a roll include breath mints (such as Lifesavers, registered trademark of Lifesavers Corporation) and digestive aids (such as Tums, registered trademark of Norcliff Thayer Inc.). Typically, when a tablet is removed from one end of a roll, some of the roll's foil is torn off in order to access the tablet, often exposing the remainder of the roll to adverse environmental influences. Additionally, users will often discard the end-most tablet from the roll that has been exposed to the environment, thus wasting tablets.

SUMMARY & OBJECTIVES OF THE INVENTION

Accordingly, objectives of the invention are to 1) protect a roll of tablets from environmental conditions that could cause tablets to spoil, 2) provide a means of separating a tablet from a wrapped roll, 3) have an attractive appearance, 4) be simple to operate, 5) minimize the dispenser's physical size, and 6) be easy to mold for plastic manufacture.

The invention includes a hollow case having an interior wall that conforms to the shape and size of a roll of tablets. In one preferred embodiment, the case has an open end for loading a roll inside the case, another open end on the opposite side of the loading end for removal of tablets from the roll. The dispenser further comprises a closure cap that covers the dispensing end of the case when the cap is in a closed position. The cap includes an interior wall that has teeth for cutting the foil-wrapper of the roll. The teeth sever the foil between the tablet at the dispensing end of the roll (i.e. the end-most tablet) and its adjacent tablet. The teeth dig under the tablet to be dispensed and lift it from the roll when the cap is flipped (i.e. pivoted) to an open position. The cap is connected to the outside body of the case via an arm, and a pivoting means such as a living hinge (made from thin polypropylene plastic) or other pivoting means known in the art. The pivot location is sufficiently far down from the dispensing end of the case so that the teeth cut and lift the end-most tablet on an angle from the longitudinal axis of the case, for easy dispensing. Typically, a paper cover fits around the foil wrapped roll of tablets, whereby the roll has a close sliding fit inside the paper cover. The cover identifies the brand name of the tablets. The roll (including the outside paper) is inserted into the loading end of the case and pressed in as far as possible (with the cap in a closed position). A portion of the interior wall of the case is contoured slightly outward toward the loading end of the case, for easy insertion of the roll. Once the outside paper is in as far as possible, it hugs the inside wall of the case. The interior of the cap conforms to the size and shape of a tablet. The interior side wall of the cap has a row of teeth located opposite the pivot arm. When the roll is pressed in as far as possible, the end-most tablet at the dispensing end snugly fits within the interior of the cap, and the teeth of the cap are automatically aligned with the foil between the end-most tablet and its adjacent tablet (where the foil is to be severed). With the end-most tablet located within the interior of the cap, the cap is then flipped open with an upward action by the thumb of the same hand that holds the case, when it is desired to dispense a tablet from the roll. The tablet is then removed from the dispenser, and any residual foil is torn off from the dispenser. The cap is then closed to protect the roll from the environment. When the next tablet is desired to be dispensed, the index or other finger of one hand is inserted inside the loading end of the case and the roll is pressed in again as far as possible. The cap is flipped open again for dispensing a tablet. This process is repeated until all tablets of the roll have been dispensed. An optional removable or hinge cap may be utilized at the loading end of the case to provide additional protection. However, since the end of the roll at the loading end will normally be completely wrapped in foil, it is not subject to adverse environmental influences like the portion of the roll on the dispensing end.

In an alternative embodiment, a tablet may be removed from the roll with the use of a thumb nail or other means external to the dispenser. With this embodiment, the cap would not require cutting teeth.

In another embodiment, the roll of tablets is advanced within the case by utilizing the force of gravity. The roll is loaded at the dispensing end of the case (i.e. the case has only one opening). The interior dimensions of the case are slightly larger than the roll so that the roll is easily dropped into the case, but not too large so that there would be too much play between the roll and the interior wall(s) of the case. A cap that is attached to the case seals the roll from its external environment and also serves as a cutting tool. When it is desired to remove the end-most tablet from the roll, the dispenser is positioned so that the end of the case which is attached to the cap is facing downward so that the force of gravity allows the end-most tablet to fit within the interior of the cap. There are cutting teeth attached to the cap. In the process of opening the cap, the foil between the end-most tablet and its adjacent tablet is severed. To prevent the roll from falling out of the case (when the cap is opened), a cam action brake is utilized which automatically holds the roll in place as the cap is opened. As previously stated, this embodiment utilizes the force of gravity to advance the roll. Alternatively, a spring can be utilized for advancing the roll, which would also require a braking mechanism to hold the roll in place when the cap is opened.

In another embodiment, cutting teeth are located not only on an interior wall of the cap, but also along an edge of the dispensing end of the case, on the side of the case where the hinge is located. When the cap is opened, the teeth of the cap pull the end-most tablet toward the teeth of the case in a direction which is substantially orthogonal to the longitudinal axis of the case, thus cutting the foil. The orthogonal motion is accomplished by placing the pivot point far enough below the dispensing end of the case. Alternatively, the distance that the tablet is pulled is short, and is followed by a lifting action as previously described. A double hinge provides this two stage kind of motion.

In another alternative embodiment, the cap rotates in a plane that is orthogonal to the longitudinal axis of the case, for cutting the foil and dispensing a tablet. The cap is attached to the case by a press-fit pin, which acts as a pivot point or hinge. The cap has cutting teeth which are located along an interior wall of the cap.

The above and other objects, advantages, and features of the invention will become more fully apparent when the following detailed descriptions of preferred embodiments of the invention are read in conjunction with the accompanying drawings.

INDEX OF REFERENCE NUMBERS

| | |
|---|---|
| 1 | hollow case |
| 2 | cap |
| 3 | interior wall of case |
| 4 | loading end of case |
| 5 | dispensing end of case |
| 6 | pivot location |
| 7 | slotted hinge arm |
| 8 | exterior top wall of cap |
| 9 | interior top wall of cap |
| 10 | exterior side wall of cap |
| 11 | interior side wall of cap |
| 12 | a tooth |
| 13 | paper cover |
| 14 | foil-wrapper |
| 15 | end-most tablet |
| 16 | adjacent tablet |
| 17 | serration |
| 19 | round hole |
| 20 | round protrusion |
| 21 | living hinge |
| 22 | pivot arms |
| 23 | piece |
| 24 | exterior wall of case |
| 25 | teeth of cap |
| 26 | nub |
| 27 | side wall of cap |
| 28 | piece on exterior wall of case for living hinge |
| 29 | press-fit pin |
| 30 | recess |
| 31 | protrusion |
| 32 | dimple |
| 33 | dispensing edge of case |
| 34 | teeth of case |
| 35 | metal pin |
| 36 | living hinge arm |

DETAILED DESCRIPTION OF PREFERRED EMBODIMENTS

Figure 1:
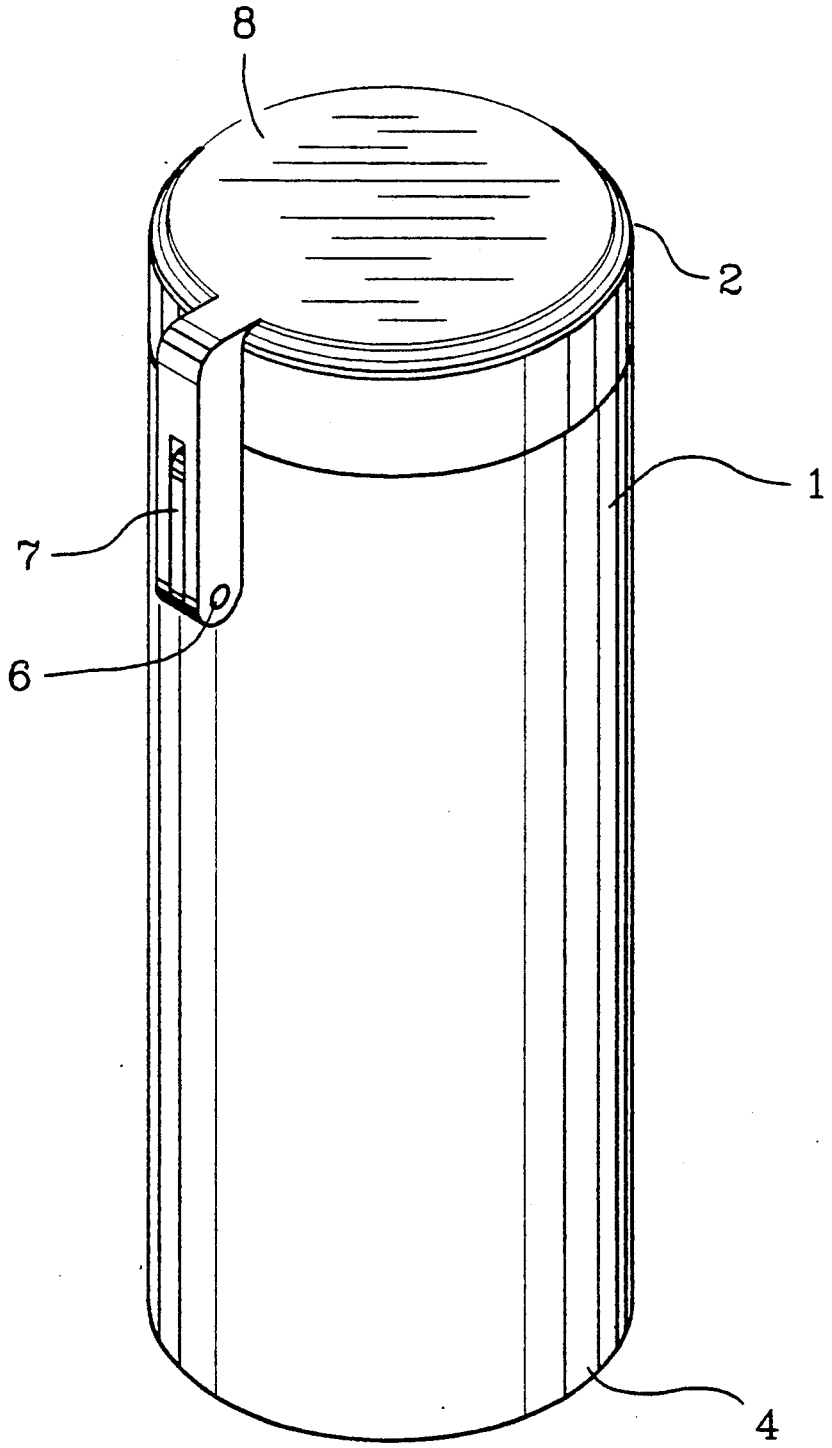
FIG. 1 is a perspective view of a embodiment with the cap in a closed position.

FIG. 1 is a perspective view of a dispenser. The hollow case 1 houses a roll of tablets. The loading end 4 of the case 1 receives the roll. The cap 2 is shown in a closed position. The slotted hinge arm 7 is connected to the exterior of the case 1 at the pivot location 6, which is sufficiently far from the exterior top wall 8 of the cap 2, so that when the cap 2 is flipped opened, it lifts a tablet from the roll on an angle from the longitudinal axis of the case 1.

Figure 2:
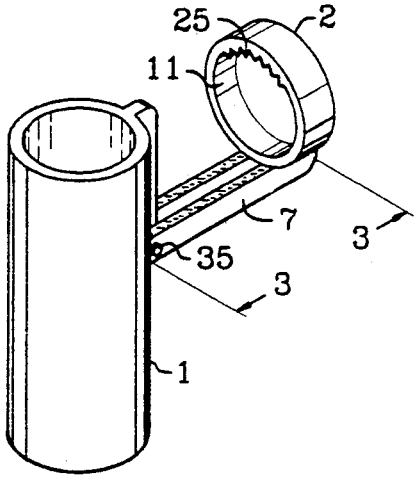
FIG. 2 is a perspective view of the embodiment as in FIG. 1 with the cap in an open position.
Figure 3:
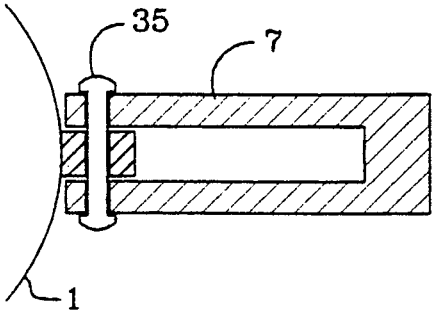
FIG. 3 is a plane view through A—A of FIG. 2.

FIG. 2 is a perspective view of a dispenser as in FIG. 1, but with the cap 2 in an open position. Teeth 25 are located on the interior side wall 11 of the cap 2. FIG. 3 is a plane view of FIG. 2 through A—A. The slotted hinge arm 7 rotates around the metal pin 35.

Figure 4:
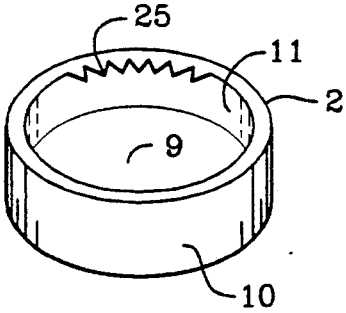
FIG. 4 is a perspective view of a cap, showing its interior.

FIG. 4 is a perspective view of a cap 2, which shows its interior side wall 11, exterior side wall 10, and interior top wall 9 of the cap 2 facing upward. Before a tablet is dispensed, the roll is pressed in all the way until the tablet at the dispensing end is flush against the interior top wall 9 of the cap 2. The teeth 25 are shown on the interior side wall 11 of the cap 2.

Figure 5:
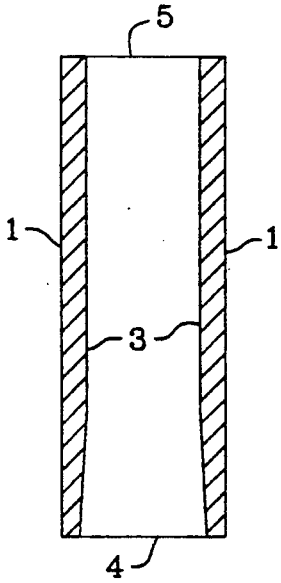
FIG. 5 is a cross-sectional view of a dispenser's case.

FIG. 5 is a cross-sectional view of the dispenser's hollow case 1. The roll of tablets is inserted in the loading end 4 and are pressed in all the way toward the dispensing end 5 of the case 1.

The interior wall 3 of the case 1 conforms to the size and shape of the roll. A portion of the interior wall 3 is contoured slightly outward toward the loading end 4, for easy insertion of the roll.

Figure 6:
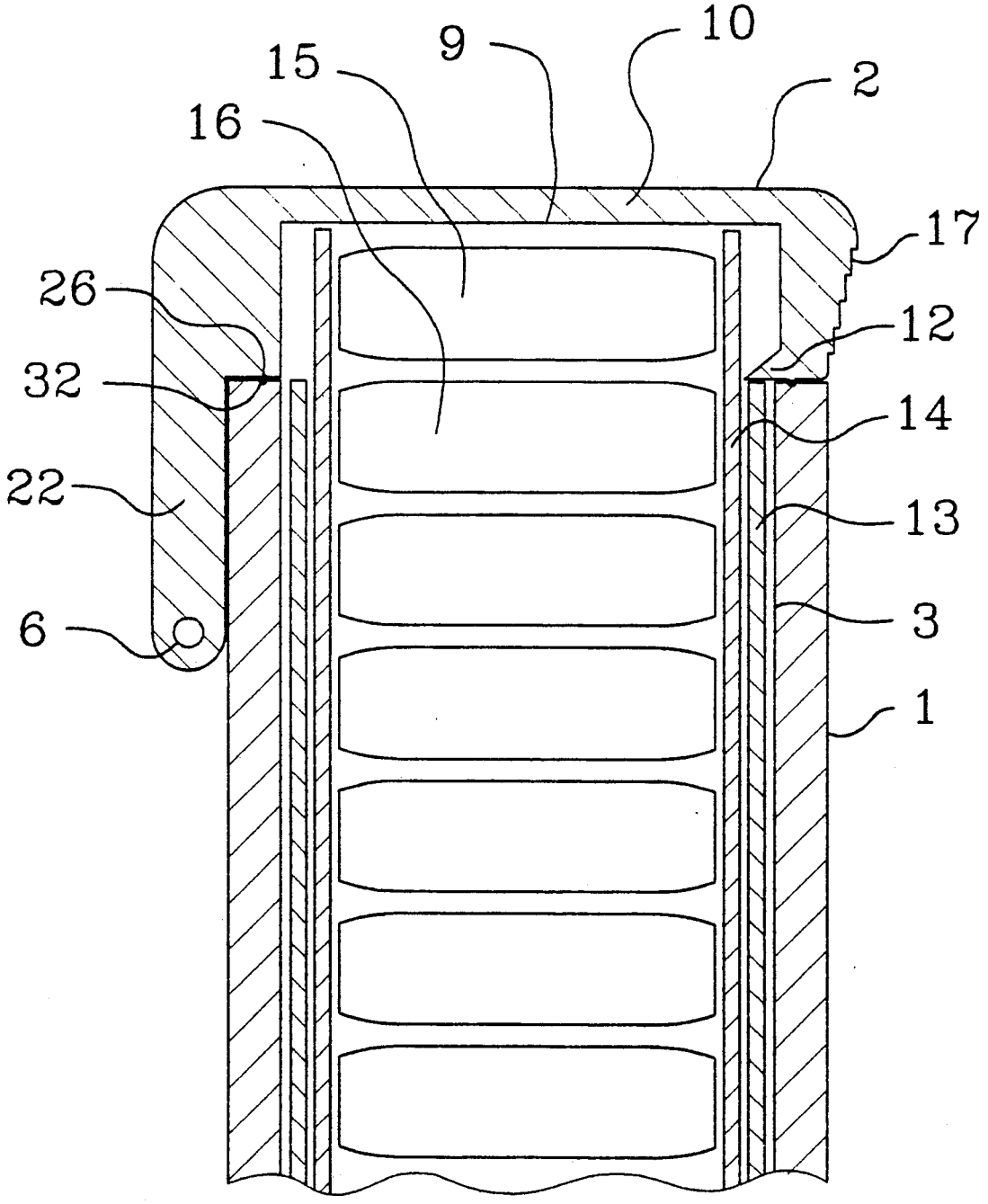
FIG. 6 is a cross-sectional view of a portion of a dispenser with a roll of tablets inside the case.

FIG. 6 shows a cross-sectional view of a portion of the dispenser with the cap 2 in its closed position. The end-most tablet 15 is flush against the interior top wall 9 of the cap 2. A tooth 12 cuts the foil-wrapper 14 between the end-most tablet 15 and its adjacent tablet 16. The end-most tablet 15 is removed from the roll. After removal, the residual foil is peeled off and the cap 2 is put in its closed position. The paper cover 13 hugs the interior wall 3 of the case 1, and remains stationary as the roll is advanced for dispensing tablets. The foil wrapped roll slides inside the paper cover 13 toward the cap 2, when the roll is pressed in as far as possible. As shown, the tooth 12 does not cut the paper cover 13. The serrations 17 are located on the exterior side wall 10 of the cap 2, as shown, to provide a gripping surface for the thumb, when the cap is flipped open. The nubs 26 are used with mated dimples 32 to snap shut the cap 2 to the case 1. The pivot arm 22 hinges at pivot location 6 to open and close the cap 2.

Figure 7:
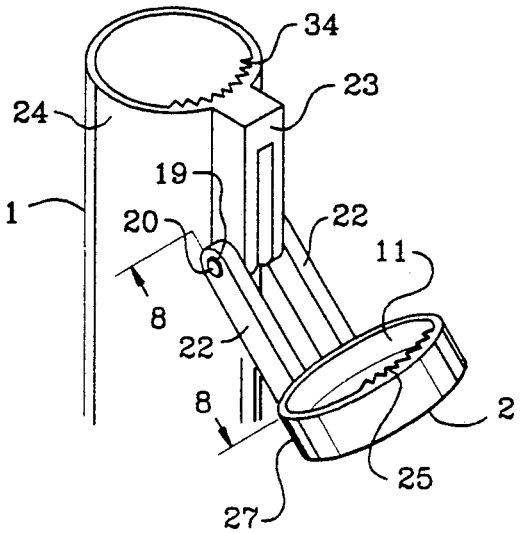
FIG. 7 is a perspective view of an embodiment with an alternative hinge structure, and with cutting teeth along the dispensing edge of the case, as well as teeth along an interior wall of the cap.
Figure 8:
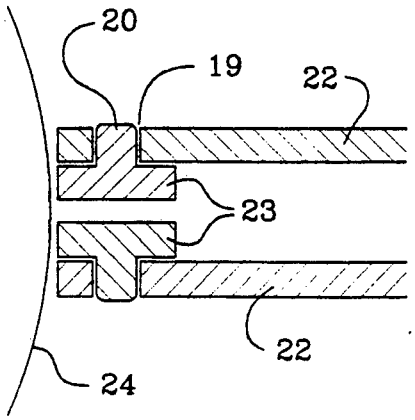
FIG. 8 is a plane view through B—B of FIG. 7.

FIG. 7 is a perspective view of a dispensing portion of an embodiment with an alternative hinge structure to that shown in FIG. 2. FIG. 7 also shows cutting teeth 34 located along the edge of case 1, as well as cutting teeth 25 along the interior side wall 11 of cap 2. When the cap 2 is opened, the teeth 25 of the cap 2 pull the end-most tablet toward the teeth 34 of the case 1, thus cutting the roll. FIG. 8 is a plane view of FIG. 7 through B—B. There are two pivot arms 22 which extend from the side wall 27 (shown in FIG. 7) of the cap 2. Near the end of each pivot arm 22, there is a round hole 19. The piece 23 on the exterior wall 24 of case 1 is slit as shown in FIG. 7 and FIG. 8, and has some springiness. The piece 23 has round protrusions 20 that correspond to and fit through the holes 19 when the pivot arms 22 are squeezed together and the protrusions 20 are aligned with holes 19. The outward force of the slit piece 23 insures that the pivot arms 22 remain attached to the piece 23. The pivot arms 22 rotate on the round protrusions 20 of piece 23, so that the cap 2 can open and close.

Figure 9:
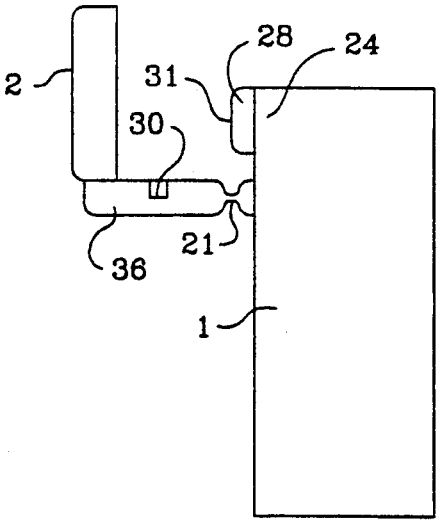
FIG. 9 is a side view of a dispenser which utilizes a plastic living hinge.
Figure 10:
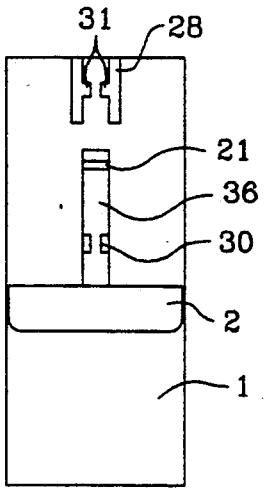
FIG. 10 is a front plane view of a dispenser as in FIG. 9, which utilizes a living hinge.

FIG. 9 shows a side view of an embodiment with a living hinge 21. FIG. 10 is a front plane view of the embodiment of FIG. 9 but with the cap 2 opened all the way. The recesses 30 on each side of the living hinge arm 36 fit to the protrusions 31 on each side of the pieces 28, when the cap 2 is closed. The pieces 28 are located on the exterior wall 24 of the case 1. With this embodiment, the entire dispenser may be injection molded as one piece in a sufficiently hard polypropylene. The living hinge 21 is a thin flexible portion of the living hinge arm 36.

Figure 11:
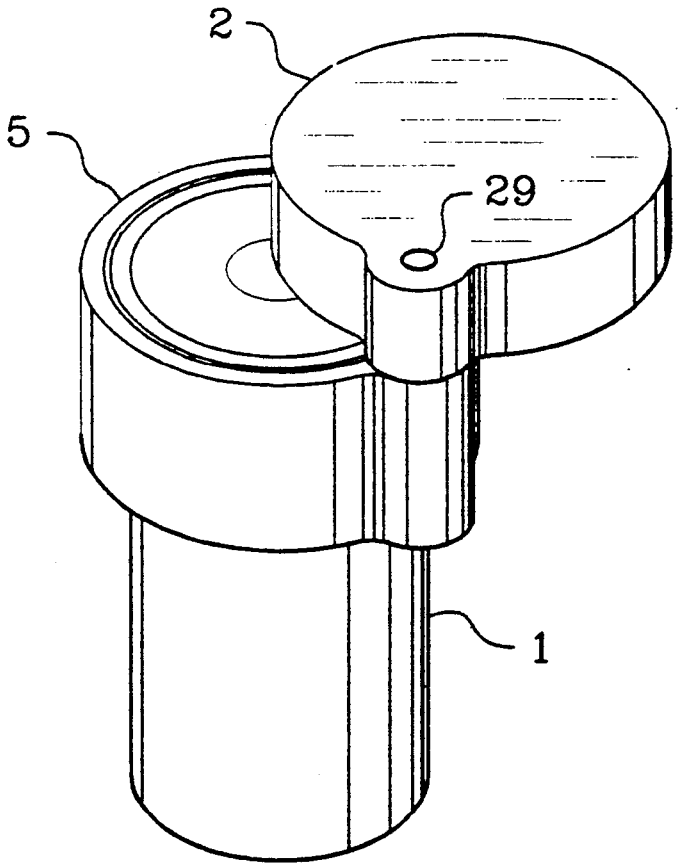
FIG. 11 is a perspective view of an embodiment with a cap rotating in an orthogonal plane to the longitudinal axis of the case.

FIG. 11 is a perspective view of a dispenser with the cap 2 which rotates in a plane that is orthogonal to the longitudinal axis of the case 1. The cap 2 is attached to the dispensing end 5 of the case 1 by a press-fit pin 29, which acts as a pivot point or hinge. There is at least one tooth or other serrated protrusion on an interior wall of the cap.

The above disclosed invention has a number of particular features which should preferably be employed in combination, although each is useful separately without departure from the scope of the invention. While we have shown and described the preferred embodiments of our invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

We claim:

1. A dispenser for housing a wrapped roll of stacked objects of identical shape and size, and for removing said objects from said roll, one at a time, said dispenser comprising:

a hollow case including an open end for loading said roll into said case, an interior that conforms to the exterior shape and size of said roll, and an open dispensing and opposite the loading end for dispensing said objects from said roll;

(b) a closure cap that covers said dispensing end of said hollow case when said cap is in a closed position, said cap having an interior cavity of thickness generally the thickness of an end-most object, and said interior cavity conforming to the shape and size of said end-most object, and said cap having an inwardly directed cutting means located on one side of said cap for partially severing the wrapper of said roll;

(c) pivot means for providing a pivot between said cap and said case, said pivot means located on the side of said case opposite the location of said cutting means of said cap, and said pivot means also located below said dispensing end of said case, so that said inwardly directed cutting means partially severs said wrapper and lifts and separates said end-most object from said roll in an upward angular direction from the longitudinal axis of said case when said cap is pivoted to an open position;

wherein said roll is inserted at the loading end of said hollow case with said cap in a closed position, and said roll is pressed in so that said end-most object is positioned in the cavity with the lower surface of said end-most object aligned just above said cutting means, whereby removal of said end-most object at the dispensing end of said roll is accomplished by partially severing said wrapper as said cutting means and said cap are pivoted to an open position.

2. The dispenser according to claim 1, in which said cutting means includes teeth.

3. The dispenser according to claim 2, in which said teeth are molded within an interior wall of said cap.

4. The dispenser according to claim 1, in which said pivot means includes a plastic living hinge.

5. The dispenser according to claim 1, in which said pivot means includes a pin attached to a slotted hinge arm.

6. The dispenser according to claim 1, in which an interior wall of said case has a slight outward contour extending from said dispensing end to said loading end, wherein said contour is with respect to the longitudinal axis of said case, whereby said outward contour facilities loading of said roll into said case.

* * * * *